US010331056B2

(12) United States Patent
Anufa et al.

(10) Patent No.: US 10,331,056 B2
(45) Date of Patent: Jun. 25, 2019

(54) CHARGING ELEMENTS IN ELECTROPHOTOGRAPHIC PRINTERS

(71) Applicant: HP INDIGO B.V., Amstelveen (NL)

(72) Inventors: Asaf Anufa, Ness Ziona (IL); Shmuel Borenstain, Ness Ziona (IL); Maty Verner, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/747,985

(22) PCT Filed: Jan. 14, 2016

(86) PCT No.: PCT/EP2016/050619

§ 371 (c)(1),
(2) Date: Jan. 26, 2018

(87) PCT Pub. No.: WO2017/121476

PCT Pub. Date: Jul. 20, 2017

(65) Prior Publication Data

US 2018/0217519 A1 Aug. 2, 2018

(51) Int. Cl.

| | |
|---|---|
| ***G03G 15/02*** | (2006.01) |
| ***G03G 15/10*** | (2006.01) |
| ***G03G 15/16*** | (2006.01) |
| ***G03G 21/06*** | (2006.01) |

(52) U.S. Cl.

CPC ..... *G03G 15/0266* (2013.01); *G03G 15/10* (2013.01); *G03G 15/104* (2013.01); *G03G 15/169* (2013.01); *G03G 21/06* (2013.01)

(58) Field of Classification Search

USPC ..... 399/50, 168, 169, 237–240, 302, 308
See application file for complete search history.

(56) References Cited

U.S. PATENT DOCUMENTS

| | | | | |
|---|---|---|---|---|
| 3,121,010 | A | 2/1964 | Johnson et al. | |
| 5,916,718 | A * | 6/1999 | Kellie | G03G 15/0152 399/178 |
| 5,940,665 | A * | 8/1999 | Domoto | G03G 15/11 399/241 |
| 5,991,577 | A | 11/1999 | Liu et al. | |
| 6,042,917 | A | 3/2000 | Schlueter et al. | |
| 6,097,920 | A | 8/2000 | Hara et al. | |
| 6,625,415 | B2 | 9/2003 | Nakashima et al. | |
| 6,996,361 | B2 | 2/2006 | Ichida et al. | |
| 8,426,100 | B2 | 4/2013 | Chun et al. | |

FOREIGN PATENT DOCUMENTS

| | | |
|---|---|---|
| EP | 0869402 | 10/1998 |

OTHER PUBLICATIONS

Lux, R. et al., Is Image-on-image Color Printing a Privileged Printing Architecture for Production Digital Printing Applications?, Xerox Corporation, Sep. 17, 2008.

* cited by examiner

*Primary Examiner* — Hoan H Tran
(74) *Attorney, Agent, or Firm* — HP Inc. Patent Department

(57) ABSTRACT

In certain examples, a liquid electrophotographic printer has a charge erasing element and a charging element. The charge erasing element at least partially discharges a charged photo imaging plate and a charged layer of liquid toner and the charging element at least partially recharges the layer of liquid toner and the photo imaging plate.

14 Claims, 5 Drawing Sheets

CHARGING ELEMENTS IN ELECTROPHOTOGRAPHIC PRINTERS

BACKGROUND

Liquid electrophotographic printing, also referred to as liquid electrostatic printing, uses liquid toner to form images on a print medium. A liquid electrophotographic printer may use digitally controlled lasers to create a latent image in the charged surface of an imaging element such as a photo imaging plate (PIP). In this process, a uniform static electric charge is applied to the photo imaging plate and the lasers dissipate charge in certain areas creating the latent image in the form of an invisible electrostatic charge pattern conforming to one colour separation of the image to be printed. An electrically charged printing substance, in the form of liquid toner, is then applied and attracted to the partially-charged surface of the photo imaging plate, recreating a separation of the desired image.

In certain liquid electrophotographic printers, a transfer member, such as an intermediate transfer member (ITM) is used to transfer developed liquid toner to a print medium. For example, a developed image, comprising liquid toner aligned according to a latent image, may be transferred from a photo imaging plate to a transfer blanket of an intermediate transfer member. This transfer occurs via predominantly electrical and mechanical forces that exist between the charged liquid toner and the intermediate transfer member which is often biased at a particular voltage level. Pure mechanical force, using zero electrical potential difference between the blanket of the intermediate transfer member and liquid toner produces poor print quality. From the intermediate transfer member, the toner is transferred to a desired substrate, which is placed into contact with the transfer blanket.

At least two different methodologies may be used to print multi-color images on a liquid electrophotographic printer. These involve the generation of multiple separations, where each separation is a single-color partial image. When these separations are superimposed, they result in the desired full color image being formed. In a first methodology, a color separation layer is generated on the photo imaging plate, transferred to the intermediate transfer member and is finally transferred to a substrate. Subsequent color separation layers are similarly formed and are successively transferred to the substrate on top of the previous layer(s). This is sometimes known as a "multi-shot color" imaging sequence. In a second methodology, a "one shot color" process is used. In these systems, the photo imaging plate transfers a succession of separations to the transfer blanket on the intermediate transfer member, building up each separation layer on the blanket. Once some number of separations are formed on the transfer blanket, they are all transferred to the substrate together.

BRIEF DESCRIPTION OF THE DRAWINGS

Various features will be apparent from the detailed description which follows, taken in conjunction with the accompanying drawings, which together illustrate, by way of example only, certain examples, and wherein.

DETAILED DESCRIPTION

Figure 1:
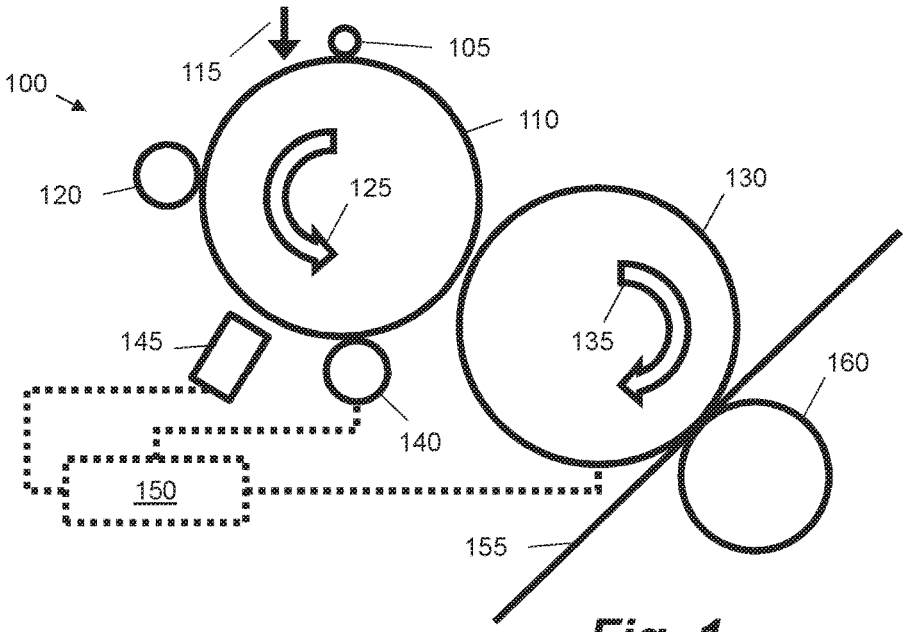
FIG. 1 is a schematic diagram showing a liquid electrophotographic printer in accordance with an example.

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

As described herein, an example liquid electrophotographic printer comprises an imaging element such as a photo imaging plate (PIP). The photo imaging plate may be implemented, for example, as a drum or a belt. A first charging element charges the photo imaging plate and a latent image is generated on the photo imaging plate. At least one image development unit deposits a charged layer of liquid toner onto the charged the photo imaging plate. In one example, each image development unit deposits a different coloured layer of liquid toner onto the photo imaging plate. Those skilled in the art will appreciate that some areas of the photo imaging plate will be charged, and charge in some other areas will have been dissipated by the lasers in generating the latent image. The areas where the layer of liquid toner is applied will form the inked image and the remaining areas will be background areas which do not contain printing liquid. An example liquid toner comprises ink particles and a carrier liquid. The ink or pigment particles are charged and may be arranged upon the photo imaging plate based on a charge pattern of a latent image. The inked image comprises ink particles that are aligned according to the latent image. In an example, the ink particles may be in the order of about 1-2 microns in diameter. An intermediate transfer member receives the inked image from the photo imaging plate and transfers the inked image to a print substrate. In one example, the ITM is heatable.

In an example electrophotographic printer, a charge erasing element, sometimes known as a pre-transfer eraser (PTE) unit is used to at least partially discharge the charged layer of liquid toner before being transferred to the ITM. The charge erasing element also at least partially discharges the charged background areas of the photo imaging plate. In one example, the charged background area is completely discharged by the charge erasing element. Here "discharging" means reducing the absolute charge in an area, or the whole area, of the liquid toner and/or photo imaging plate. "Discharging" also means reducing the absolute voltage of an area, or the whole area, of the liquid toner and/or photo imaging plate.

In an example electrophotographic printer, a second charging element at least partially recharges the layer of liquid toner after it has been at least partially discharged by the charge erasing element. The second charging element also at least partially recharges the background areas of the photo imaging plate which do not contain printing liquid. Here "recharging" means increasing the absolute charge in an area, or the whole area, of the liquid toner and/or photo imaging plate. "Recharging" also means increasing the absolute voltage of an area, or the whole area, of the liquid toner and/or photo imaging plate. In one example, the second charging element increases the absolute charge/voltage of the liquid toner and/or photo imaging plate to a value that is less than the absolute charge/voltage of the liquid toner and/or photo imaging plate prior to being partially discharged by the charge erasing element. In another example, the second charging element increases the absolute charge/voltage to a value that is greater than it was prior to being partially discharged by the charge erasing element.

In one example electrophotographic printer, the printer comprises a grounded intermediate transfer member. The intermediate transfer member receives the at least partially recharged layer of liquid toner from the at least partially recharged photo imaging plate and transfers the at least partially recharged layer of liquid toner to a print substrate.

In some example electrophotographic printers, the intermediate transfer member is not grounded, and is instead biased at a high voltage. The intermediate transfer member could for example be biased at about +550V to +600V. When the intermediate transfer member is biased in this way, a negatively charged ink on the photo imaging plate will be transferred, via electrostatic forces, onto the intermediate transfer member. In an example, the ink on the photo imaging plate is negatively charged and has a voltage of about −500V, and the bare, background areas of the photo imaging plate have a voltage of about −1000V. In this case, a potential difference of around 1550V exists between the photo imaging plate background regions and the intermediate transfer member. Although this scenario enables the transfer of the ink to the intermediate transfer member, the high potential difference can produce damaging breakdown currents between the PIP and the ITM which can significantly shorten the blanket lifespan.

To prevent this effect from occurring, the charge erasing element, such as the pre-transfer eraser (PTE) is used to discharge the potential of the ink and the bare background regions of the PIP. A PTE comprises a set of diodes to illuminate the PIP. Illumination causes a homogeneous conductivity across the PIP leading to dissipation of the charges still existing on the background. This enables a clean transfer of the image to the ITM while avoiding the background charges from sparking to the heated blanket of the ITM and damaging the image and, in time, the PIP and the heated blanket.

In one example, the ink, originally at −500V, is discharged to about −150V and the PIP, originally at −1000V is discharged to about 0V by the charge erasing element. Various methods of controlling discharge are known to those skilled in the art. For example, discharge can be controlled by varying the irradiance. Those skilled in the art will appreciate that the PIP may not be completely discharged to 0V, but in reality will discharge to V-light; a residual voltage which remains on the PIP. In some examples V-light may be approximately 0V, however in other examples it may be up to about −150V.

Once the image and the background have been discharged, the potential difference between the background and the ITM is around 550V instead of being around 1550V prior to being exposed to the charge erasing element. Because this potential difference is much lower, the likelihood of damaging breakdown currents existing is less. Furthermore, the potential difference of about 700V between the ink and the ITM enables the ink to be transferred to the ITM via electrostatic force. However, in standard printers using a biased ITM and a charge erasing element, residual charges in the background may also be transferred to the ITM. These background charges can negatively affect the image quality and reduce the lifespan of the blanket on the ITM.

Furthermore, in order to allow printing on a conductive substrate, cumbersome workarounds are employed in known systems to prevent the occurrence of high voltage breakdown between the biased ITM and the substrate. These voltage breakdowns are exhibited as violent sparks on the substrate, which can damage it. Existing solutions involve the use of insulating ITM drum bearings which are expensive. Furthermore, these bearings have a short life span meaning difficult, regular maintenance is involved.

Existing printers may ground the ITM only the moment before the transfer from the ITM to the substrate, however due to the response times of the electronics, null cycles are used, which reduces the productivity of the printer. A null cycle is a rotation of the ITM, for example, without making a transfer. Alternatively, a constantly grounded ITM produces poor quality images because the electrostatic forces that exist between the ink and the PIP background with the grounded ITM mean poor transferability of the ink and high transferability of the background charges. The high transfer of background charges leads to a shorter lifespan of the ITM blanket.

In the present examples contained herein, improved electrophotographic printers are provided that allow printing on a conductive substrate without the associated difficulties of present printers. The example printers also produce higher quality images with low background charge transfer which leads to a longer blanket lifespan.

In these examples, a charge erasing unit is used to at least partially discharge the PIP and image, and a second charging unit at least partially recharges the PIP and image to a particular bias, such that transfer of the PIP to the ITM is achieved adequately, while residual background charges remain on the PIP. The combination of the charge erasing unit and the second charging unit results in good transfer of the image, but not transfer of the background charges.

Furthermore, in one example printer, the ITM blanket is grounded which means that printing on conductive substrates can be achieved without the cumbersome workarounds to prevent high voltage breakdown between the ITM and the substrate. Grounded may be taken to mean at, or approximately at, 0V.

The combined effect of the charge erasing unit, the second charging element and the grounded ITM, mean that potential differences can be achieved which allow good transfer of the image but not the background, and printing can be performed on conductive media without the associated difficulties and expense. It is desirable to reduce the transfer of the background because this can introduce printing defects, such as holes in the image, as well as negatively affecting the blanket lifespan.

The potential difference between the inked image, background and the ITM can affect the following print quality factors: short term and negative dot gain, small dot transfer, fog level and blanket lifespan. For example, short term and negative dot gain can be caused by the potential difference between the image and the background. This can be reflected in a difference in dot area diameter between the image and the background. Use of the charge erasing unit before the second charging element reduces these unwanted effects and increases print quality. Fog levels can be dependent on the potential difference between the inked image and the ITM. A lower fog level is desirable, which can be achieved by increasing the potential difference between the image and the ITM. However as previously described, if the potential difference is too great, electrical breakdown can occur. Therefore a balance can enable better print quality. Breakdown can cause memories of a previous image to be retained on the ITM blanket during printing of a new image. These memories may be undesirable and can reduce blanket lifespan. Memories can impact the background area to a greater extent than the image area. Furthermore, recharging the ink can enable good transfer of small dots which increases with increased potential difference. Certain examples described herein improve the print quality by using the charge erasing element before recharging by the second charging unit in combination with a grounded ITM.

FIG. 1 is a schematic diagram showing a liquid electrophotographic printer 100 in accordance with an example. Liquid electrophotography, sometimes also known as Digital Offset Color printing, is the process of printing in which liquid toner is applied onto a surface having a pattern of electrostatic charge (i.e. a latent image) to form a pattern of liquid toner corresponding with the electrostatic charge pattern (i.e. an inked image). This pattern of liquid toner is then transferred to at least one intermediate surface, and then to a print medium. During the operation of a digital liquid electrophotographic system, ink images are formed on the surface of a photo imaging plate. These ink images are transferred to the blanket of an intermediate transfer member and then to a print medium.

According to the example of FIG. 1, a latent image is formed on a photo imaging plate 110 by rotating a clean, bare segment of the photo imaging plate 110 under a first charging element 105. The photo imaging plate 110 in this example is cylindrical in shape, e.g. is constructed in the form of a drum, and rotates in a direction of arrow 125. The first charging element 105 may include a charging device, such as corona wire, a charge roller, scorotron, or any other charging device. A uniform static charge is deposited on the photo imaging plate 110 by the first charging element 105. In one example, a voltage of about −1150V is applied to the first charging element 105 to enable charging. As the photo imaging plate 110 continues to rotate, it passes an imaging unit 115 where one or more laser beams dissipate localized charge in selected portions of the photo imaging plate 110 to leave an invisible electrostatic charge pattern that corresponds to the image to be printed, i.e. a latent image. In some implementations, the first charging element 105 applies a negative charge to the surface of the photo imaging plate 110. In other implementations, the charge is a positive charge. The imaging unit 115 then locally discharges portions of the photo imaging plate 110, resulting in local neutralised regions on the photo imaging plate 110.

In the described example, ink is transferred onto the photo imaging plate 110 by at least one image development unit 120. An image development unit may also be known as a Binary Ink Developer unit. There may be one image development unit 120 for each ink color. During printing, the appropriate image development unit 120 is engaged with the photo imaging plate 110. The engaged image development unit 120 presents a uniform film of ink to the photo imaging plate 110. The ink contains electrically-charged pigment particles which are attracted to the opposing charges on the image areas of the photo imaging plate 110. The photo imaging plate 110 now has a single color ink image on its surface, i.e. an inked image or separation. In other implementations, such as those for black and white (monochromatic) printing, one or more ink developer units may alternatively be provided.

The ink may be a liquid toner, comprising ink particles and a carrier liquid. The carrier liquid may be an imaging oil. An example liquid toner ink is HP ElectroInk™. In this case, pigment particles are incorporated into a resin that is suspended in a carrier liquid, such as Isopar™. The ink particles may be electrically charged such that they move when subjected to an electric field. Typically, the ink particles are negatively charged and are therefore repelled from the negatively charged portions of photo imaging plate 110, and are attracted to the discharged portions of the photo imaging plate 110. The pigment is incorporated into the resin and the compounded particles are suspended in the carrier liquid. The dimensions of the pigment particles are such that the printed image does not mask the underlying texture of the print substrate, so that the finish of the print is consistent with the finish of the print substrate, rather than masking the print substrate. This enables liquid electrophotographic printing to produce finishes closer in appearance to offset lithography, in which ink is absorbed into the print substrate.

Returning to the printing process, the photo imaging plate 110 continues to rotate and passes beneath the charge erasing unit 145 which at least partially discharges the charged photo imaging plate 110 and the charged layer of liquid toner. Here the charge erasing unit 145 at least partially discharges the background areas of the charged photo imaging plate 110. As explained above, the effect of this is to reduce the absolute voltage of the PIP 110 and ink. In one example, the negatively charged ink, originally at about −500V, is discharged to about −150V by the charge erasing unit 145, and the PIP 110, originally at −1000V is discharged to about 0V. Here, reference to the voltage/charge on the PIP 110 means the voltage/charge of the background regions of the PIP 110. Those skilled in the art will appreciate that when a positively charged ink is used, charges and voltages will be of the opposite polarity.

Once the image and the PIP 110 have been at least partially discharged by the charge erasing unit 145, they approach the second charging element 140. In one example the second charging element is a PIP Liquid Squeezer (PLS) and can be a roller or other charging device. An example PLS is described in international patent application number PCT/EP2015/075180. The first and second charging elements 105, 140 can be the same or different charging elements. A voltage applied to the second charging element 140 enables recharging of the PIP 110 and ink. For example, a high voltage is applied to the second charging element 140 and electrical breakdown occurs causing the absolute charge/voltage on the PIP 110 and layer of liquid toner to increase. In one example, the PIP 110 is recharged from about 0V to about −150V, and the layer of liquid toner is recharged from about −150V to about −400V. The recharging by the second charging element 140 is such that the potential difference between the layer of liquid toner and the ITM 130 increases. The discharging and subsequent recharging is performed because ink and the PIP 110 are affected differently by each of these processes. For example, the second charging element 140 does not charge the ink and PIP 110 equally. Achieving correct voltage levels to allow good transfer of the image but not the background charges, is obtained by the combined effect of the discharging and subsequent recharging. Performing just one of these processes without the other can result in lower print quality and/or reduced lifetime of the ITM blanket 130, than would occur if using both processes.

In some examples, the voltage applied to the second charging element 140 is selected/tuned to ensure that an adequate potential difference is generated to allow substantially all of the ink to be transferred to the ITM 130. In one example, the voltage applied to the second charging element is between about −700V and −1000V. In some examples the voltage is selected according to any or all of the following parameters: the type of ink, the voltage applied to the first charging element 105, the quantity of ink applied to the PIP 110 and the voltage/charge of the ink and/or PIP 110 after being exposed to the charge erasing unit 145. In one example, an electrometer (not shown) measures the charge of the PIP 110 and/or image prior to arrival at the second charging element 140. This measurement is used to determine the voltage to be applied to the second charging element 140 such that real time adjustments can be made. In some examples, the voltage applied to the ink by a given image development unit 120 is varied according to the position of the respective image development unit 120.

Once the second charging element 140 has at least partially recharged the layer of liquid toner and the PIP 110, the ink is transferred to the ITM 130. The ITM 130 may also be known as a blanket cylinder or a transfer element and it rotates in a direction of arrow 135. The transfer of an inked image from the photo imaging plate 110 to the ITM 130 may be known as the "first transfer". The first transfer of the layer of liquid toner is affected by the voltage difference that exists between the liquid toner and the ITM 130. In one example, the layer of liquid toner is at −400V and the liquid toner is transferred to the ITM 130 when the direction of the electric field vector points away from the ITM 130. For this transfer to occur, the ITM 130 can be at a voltage above −400V, such as 0V or +550V for example.

In one example, the ITM 130 is grounded. Grounded may be taken to mean at 0V, or earthed. As discussed above, a grounded ITM 130 has the benefit that printing can be performed on a conductive substrate without cumbersome workarounds being employed to prevent the occurrence of a high voltage breakdown if the ITM 130 is biased. Furthermore, the bearings of the ITM 130 (not shown) are sometimes insulating if the ITM 130 is biased. These can be expensive, have a short lifespan and are difficult to replace and maintain. Therefore a simplified ITM 130 can be used because electrical insulation/grounding is not needed when a biased ITM is being used for printing on conductive media. Furthermore, safety requirements are reduced when using a grounded ITM 130.

Simply grounding the ITM 130 without ensuring the layer of liquid toner is at the correct voltage before being transferred from the PIP 110 to the ITM 130, would mean that the potential difference for the first transfer would be too small, leading to poor transfer of the ink to the ITM 130. The charging performed by the second charging element 140 allows for the potential difference to increase to an adequate level, such that good transfer of the ink occurs. The use of the charge erasing unit 145, the second charging element 140 and the grounded blanket together means that good transfer of the image occurs and the background charges are retained on the PIP 110, while also substantially reducing unwanted effects of printing on a conductive substrate.

Once the layer of liquid toner has been transferred to the ITM 130, it is transferred to the substrate 155. This transfer from the ITM 130 to the print substrate may be deemed the "second transfer". In one example the substrate 155 is conductive and in another example the substrate 155 is non-conductive. The present electrophotographic printer is capable of printing on either conductive or non-conductive substrates. The impression cylinder 160 can both mechanically compress the print media 155 in to contact with the ITM 130 and also help feed the media 155. In one example, the impression cylinder 160 is grounded.

Controller 150, discussed in more detail below, controls part, or all, of the print process. For example, the controller 150 can control the voltage level applied to the second charging element 140, control the charge erasing element and control the rotation of the ITM 130. It will be appreciated that the controller 150 can also control any other, or all of the components of the printer 100, however connections between those elements and the controller are not shown in FIG. 1 for clarity. Furthermore, controller 150 may also be embodied in one or more separate controllers.

Figure 2A:
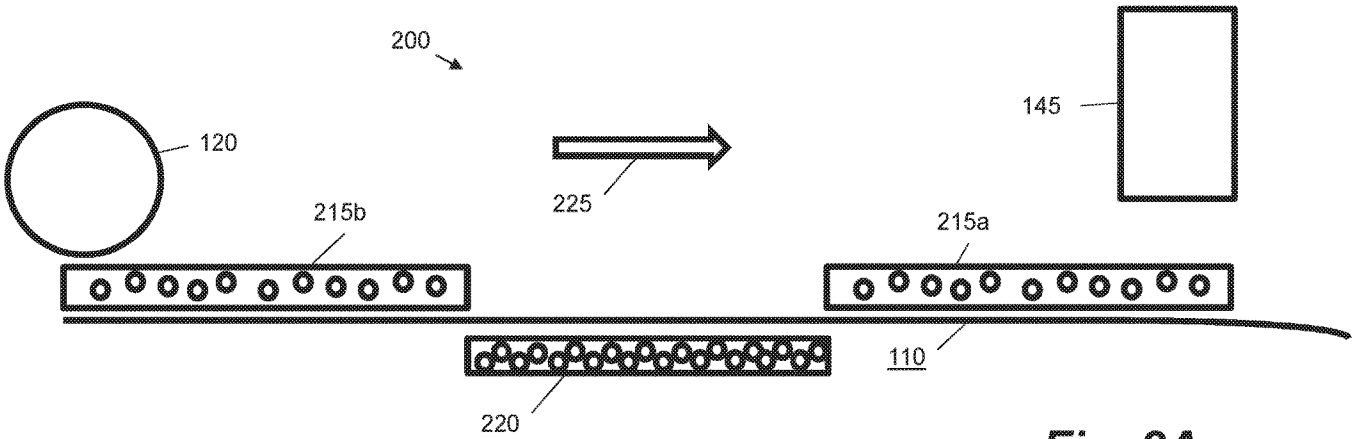
FIG. 2A is a schematic diagram showing liquid toner applied to a charged photo imaging plate in accordance with an example.

FIG. 2A is a schematic diagram 200 showing areas of liquid toner 215*a*, 215*b* applied to a photo imaging plate 110 in accordance with an example. Photo imaging plate 110, in this example, is the same as photo imaging plate 110 in FIG. 1. In this example, the areas of liquid toner 215*a*, 215*b* are part of the same layer, and form an inked image. Arrow 225 indicates the direction in which the areas of liquid toner 215*a*, 215*b* and the surface of the PIP 110 are traveling. The ink in the areas of liquid toner 215*a*, 215*b* has been applied to the surface of the PIP 110 by the image development unit 120 and the first area of liquid toner 215*a* is approaching the charge erasing element 145 to be at least partially discharged.

The charged background area 220 on the PIP 110 is shown as a localized area of charge that has not been dissipated by the laser(s) 115. Ink is repelled from this charged region 220 into the regions of the PIP 110 that have been dissipated by the laser(s) 115.

For illustration purposes, charges are depicted as the circular "particles" within the areas of liquid toner 215*a*, 215*b* and the background area 220. Therefore, a higher density of "particles" should be taken to mean a higher absolute charge in the areas 215*a*, 215*b*, 220. Similarly a higher absolute charge means a higher absolute voltage. In the example of FIG. 2A, each area of liquid toner 215*a*, 215*b* is charged at −500V and the background area 220 of the PIP 110 is charged at −1000V prior to exposure to the charge erasing element 145.

Figure 2B:
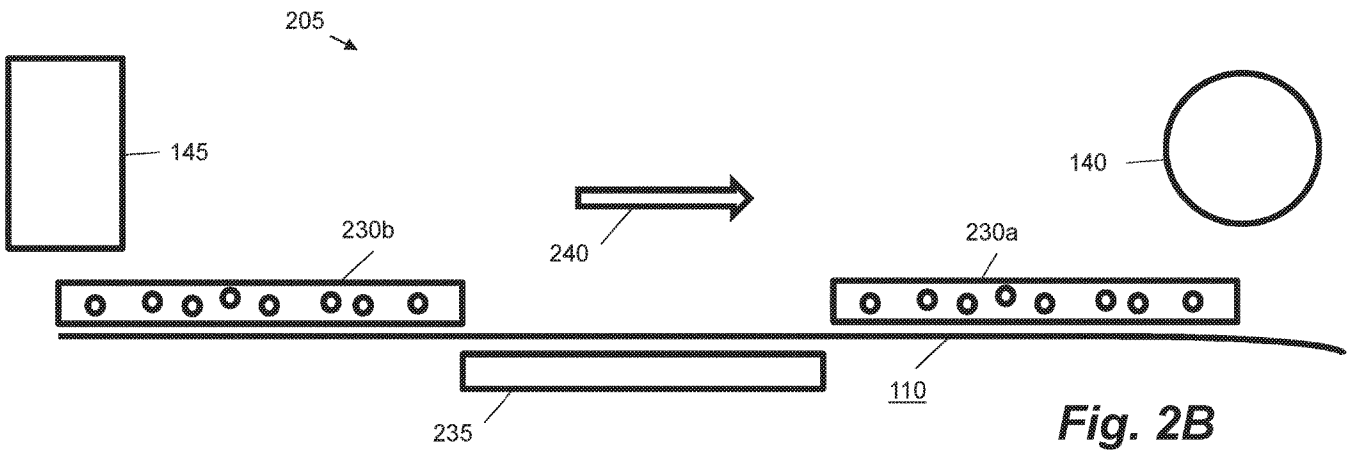
FIG. 2B is a schematic diagram showing liquid toner and the photo imaging plate after being exposed to a charge erasing element in accordance with an example.

FIG. 2B is a schematic diagram 205 showing at least partially discharged areas of liquid toner 230*a*, 230*b* and an at least partially discharged area 235 of the PIP 110. The at least partially discharged areas of liquid toner 230*a*, 230*b* are the areas of liquid toner 215*a*, 215*b* of FIG. 2A after being exposed to the charge erasing element 145. The at least partially discharged area 235 of the PIP 110 is the background area 220 of the PIP 100 after being exposed to the charge erasing element 145. Arrow 240 indicates the direction in which the at least partially discharged areas of liquid toner 230*a*, 230*b* and the surface of the PIP 110 are traveling. The first at least partially discharged area of liquid toner 230*a* is approaching the second charging element 140 to be at least partially recharged.

In this example, the absolute charge in each of the areas 230*a*, 230*b*, 235 has at least partially decreased due to the charge erasing element 145 at least partially discharging each of the areas 230*a*, 230*b*, 235. This decrease is illustrated by each area 230*a*, 230*b*, 235 containing fewer charged "particles" when compared to areas 215*a*, 215*b*, 220 in FIG. 2A. In this example, each area of liquid toner 230*a*, 230*b* has been discharged from −500V to −150V. The background area 235 has been discharged from −1000V to about 0V, which is illustrated as containing no charge.

Figure 2C:
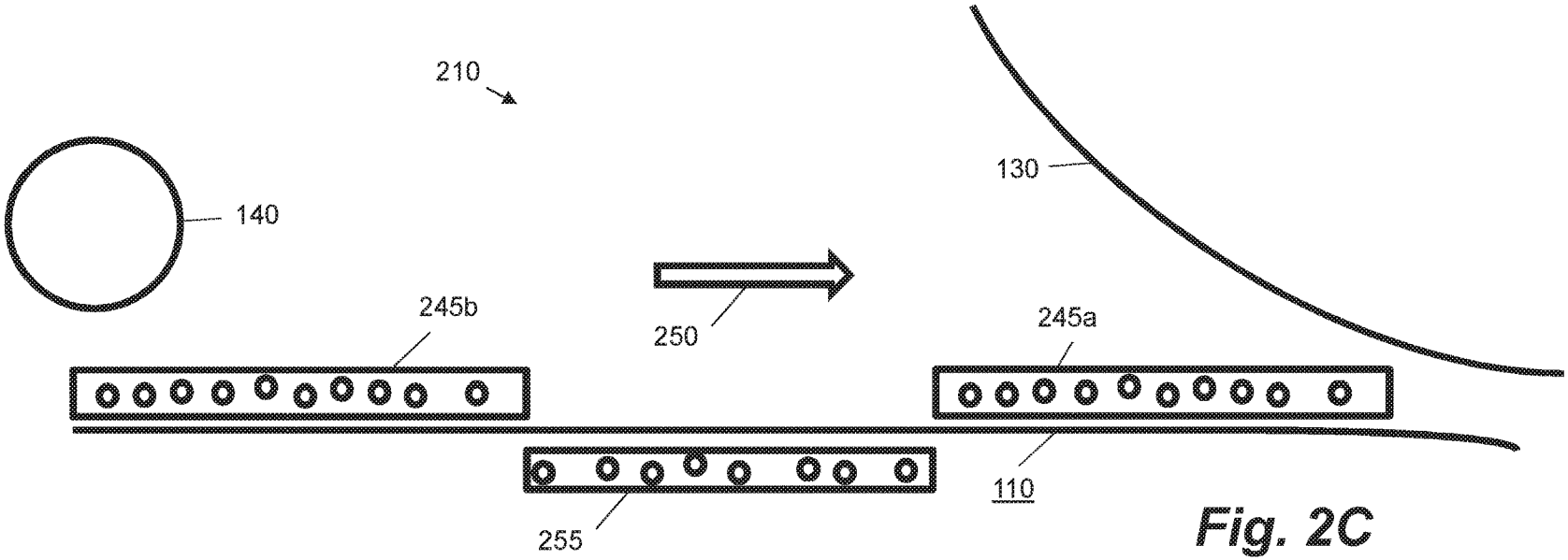
FIG. 2C is a schematic diagram showing liquid toner and the photo imaging plate after being recharged by a charging element in accordance with an example.

FIG. 2C is a schematic diagram 210 showing at least partially recharged areas of liquid toner 245*a*, 245*b* and an at least partially recharged area 255 of the PIP 110. The at least partially recharged areas of liquid toner 245*a*, 245*b* are the areas of liquid toner 230*a*, 230*b* of FIG. 2B after being exposed to the second charging element 140. The at least partially discharged area 255 of the PIP 110 is the background area 235 of the PIP 100 after being exposed to the second charging element 140. Arrow 250 indicates the direction in which the at least partially recharged areas of liquid toner 245*a*, 245*b* and the surface of the PIP 110 are traveling. The first at least partially discharged area of liquid toner 245*a* is approaching the ITM 130 to undergo first transfer.

In this example, the absolute charge in each of the areas 245*a*, 245*b*, 255 has at least partially increased due to the second charging element 140 at least partially recharging each of the areas 245*a*, 245*b*, 255. This increase is illustrated by each area 245*a*, 245*b*, 255 containing more charged "particles" when compared to areas 230*a*, 230*b*, 235 in FIG. 2B. In this example, each area of liquid toner 245*a*, 245*b* has been recharged from −150V to −400V. The background area 235 has been recharged from 0V to about −150V. To achieve this recharging, a voltage is applied to the second charging element 140. In this example, the voltage is between −700V and −1100V.

In one example, the ITM 130 is grounded. The potential difference between the areas of liquid toner 245*a*, 245*b* and the grounded ITM 130, is such that the areas of liquid toner 245*a*, 245*b* are transferred via electrostatic forces onto the blanket of the ITM 130. In this example, the potential difference between the areas of liquid toner 245*a*, 245*b* and the grounded ITM 130, is 400V. The potential difference between the background region 255 and the grounded ITM 130, is 150V, which is comparatively small, such that residual background charges are retained on the PIP 110 and are not transferred to the blanket of the ITM 130.

Figure 3:
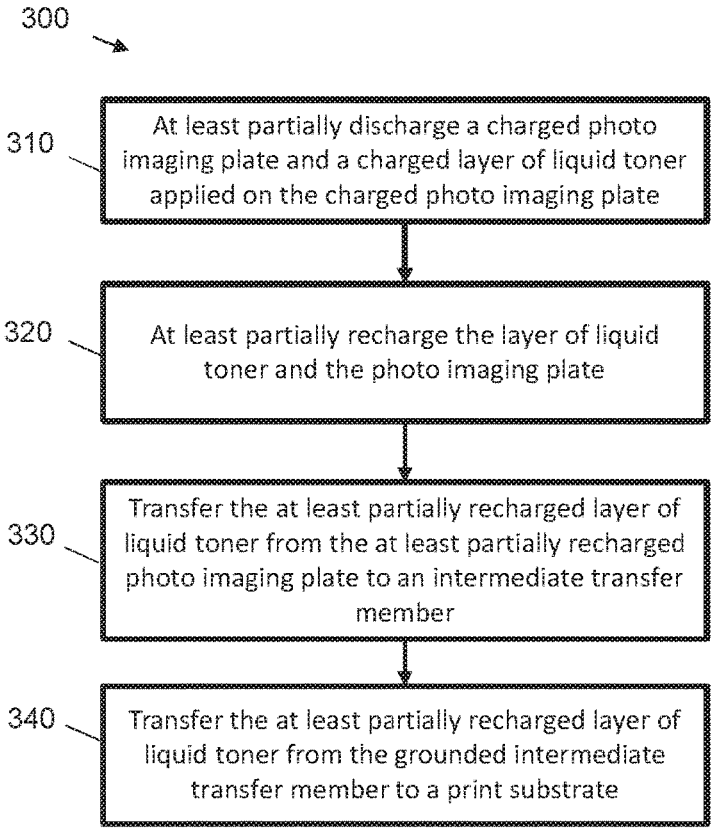
FIG. 3 is a flow diagram showing a method of printing an image in a liquid electrophotographic printer according to an example.

FIG. 3 is a flow diagram showing a method 300 of printing an image in a liquid electrophotographic printer according to an example. The method can be performed by the printer 100 discussed in FIGS. 1, 2A-C. At block 310 the method comprises at least partially discharging a charged photo imaging plate 110 and a charged layer of liquid toner 215*a*, 215*b* applied on the charged photo imaging plate 110. Reference to a charged photo imaging plate 110, can mean at an area of a charged photo imaging plate 110, such as the background area 220 depicted in FIG. 2A. In this example, the charged layer of liquid toner 215*a*, 215*b* and photo imaging plate 110 have already been charged by the first charging element 105 and are at least partially discharged by the charge erasing unit 145. At least partially discharging the photo imaging plate and the layer of liquid toner means at least partially discharging both the photo imaging plate and the layer of liquid toner.

At block 320, the method comprises at least partially recharging the layer of liquid toner 230*a*, 230*b* and the photo imaging plate 235. Here the layer of liquid toner 230*a*, 230*b* and the photo imaging plate 235 are at least partially recharged by the second charging element 140 as shown in FIGS. 2B and 2C. At least partially recharging the photo imaging plate and the layer of liquid toner means at least partially recharging both the photo imaging plate and the layer of liquid toner.

At block 330, the method comprises transferring the at least partially recharged layer of liquid toner 245*a*, 245*b* from the at least partially recharged photo imaging plate 255 to an intermediate transfer member 130. In this example method, the intermediate transfer member 130 is grounded, however in some examples the intermediate transfer member 130 is not grounded.

At block 340, the method comprises transferring the at least partially recharged layer of liquid toner 245*a*, 245*b* from the grounded intermediate transfer member to a print substrate. In this example, the print substrate is conductive, but in other examples, the print substrate is non-conductive.

In one example method, the method comprises applying a voltage to the second charging element 140 and tuning the applied voltage to adjust the recharging of the layer of liquid toner 230*a*, 230*b* and photo imaging plate 235. For example, the voltage may be predetermined or in another example the voltage is selected within a range of voltages, and in either case the amount of charge obtained by the liquid toner 230*a*, 230*b* and photo imaging plate 235 depends upon the voltage applied to the second charging element 140. The voltage applied ensures that good transfer of the liquid toner 245*a* 245*b* to the ITM 130 occurs, while also limiting the transfer of the background charge of the at least partially recharged photo imaging plate 255. For example, the applied voltage is tuned to enable substantially all of the at least partially recharged layer of liquid toner 245*a*, 245*b* to be transferred to the intermediate transfer member 130 and/or to enable substantially all of the charge on the at least partially recharged photo imaging plate 255 to be retained on the photo imaging plate 110. In some example, a suitable voltage is determined which satisfies both of these conditions.

In one example, the controller 150 controls the applied voltage.

"Tuning" the voltage means varying the voltage to a desired level. For example, the voltage during one complete printer cycle may be different to a subsequent cycle. In another example, the voltage applied may be different for each separation applied to the PIP 110. In another example, an optimum voltage may be determined, such that active tuning of the voltage does not occur. In another example, a predetermined voltage is always applied and the printer is not able to adjust the applied voltage. For example, the applied voltage level may be set by the manufacturer.

In one example, the voltage applied is the same polarity as the charged layer of liquid toner. For example, when a negatively charged liquid toner is used, the voltage applied to the second charging element 140 is also negative.

In an example printer where the ITM 130 is grounded, the grounded intermediate transfer member 130 receives the at least partially recharged layer of liquid toner 245*a*, 245*b* from the at least partially recharged photo imaging plate 255 and transfers the at least partially recharged layer of liquid toner 245*a*, 245*b* to a print substrate 155. Moreover, the intermediate transfer member 130 is grounded when the intermediate transfer member 130 receives the at least partially recharged layer of liquid toner 245*a*, 245*b* from the at least partially recharged photo imaging plate 255. Similarly, the intermediate transfer member 130 is grounded when the intermediate transfer member 130 transfers the at least partially recharged layer of liquid toner 245*a*, 245*b* to the print substrate. In this example, the ITM 130 is said to be constantly grounded.

Certain system components and methods described herein may be implemented by way of non-transitory computer program code that is storable on a non-transitory storage medium. In some examples, the controller 150 may comprise a non-transitory computer readable storage medium comprising a set of computer-readable instructions stored thereon. The controller 150 may further comprise at least one processor. Alternatively, one or more controllers 150 may implement all or parts of the methods described herein.

Figure 4:
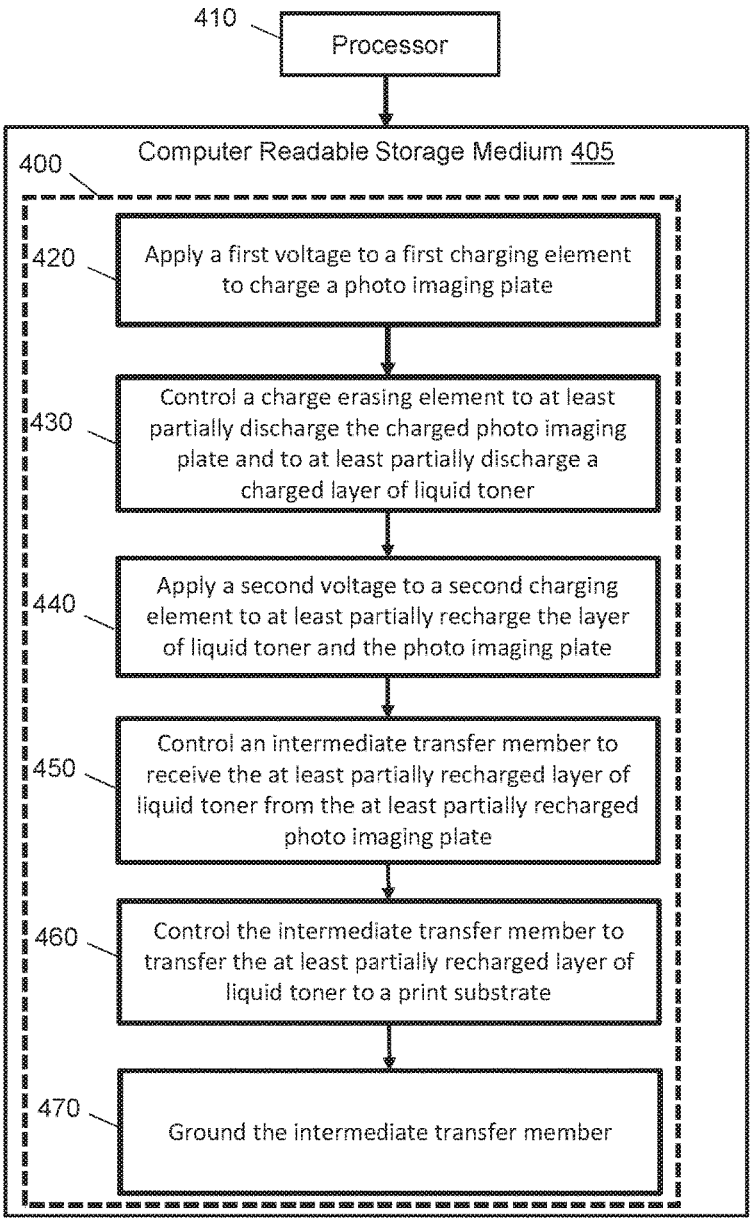
FIG. 4 is a schematic diagram showing an example set of computer-readable instructions within a non-transitory computer-readable storage medium.

FIG. 4 shows an example of such a non-transitory computer-readable storage medium 405 comprising a set of computer readable instructions 400 which, when executed by at least one processor 410, cause the processor 410 to perform a method according to examples described herein. The computer readable instructions 400 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 400 cause the processor 410 in a liquid electrophotographic printer 100 to, at block 420, apply a first voltage to a first charging element to charge a photo imaging plate.

At block 430, instructions 400 cause the processor 410 to control a charge erasing element to at least partially discharge the charged photo imaging plate and to at least partially discharge a charged layer of liquid toner on the charged photo imaging plate.

At block 440, instructions 400 cause the processor 410 to apply a second voltage to a second charging element to at least partially recharge the layer of liquid toner and the photo imaging plate.

At block 450, instructions 400 cause the processor 410 to control an intermediate transfer member to receive the at least partially recharged layer of liquid toner from the at least partially recharged photo imaging plate. Controlling the intermediate transfer member may involve enabling or causing rotation of the intermediate transfer member, and may also involve mechanically compressing the ITM onto the surface of the photo imaging plate.

At block 460, instructions 400 cause the processor 410 to control the intermediate transfer member to transfer the at least partially recharged layer of liquid toner to a print substrate. Optionally, the controller 150 may control the print substrate and the impression cylinder 160 to enable this transfer.

At block 470, instructions 400 cause the processor 410 to ground the intermediate transfer member when the intermediate transfer member receives the at least partially recharged layer of liquid toner from the at least partially recharged photo imaging plate and when the intermediate transfer member transfers the at least partially recharged layer of liquid toner to the print substrate.

While certain examples have been described above in relation to liquid electrophotographic printing, other examples can be applied to dry electrophotographic printing.

The preceding description has been presented to illustrate and describe examples of the principles described. This description is not intended to be exhaustive or to limit these principles to any precise form disclosed. Many modifications and variations are possible in light of the above teaching.

What is claimed is:

1. A liquid electrophotographic printer comprising:

a photo imaging plate;

a first charging element to charge the photo imaging plate;

at least one image development unit to develop a latent image by depositing a charged layer of liquid toner onto the charged photo imaging plate;

a charge erasing element to at least partially discharge the charged photo imaging plate and the charged layer of liquid toner; and a second charging element to at least partially recharge the layer of liquid toner and the photo imaging plates;

an intermediate transfer member, wherein the intermediate transfer member is grounded, and wherein the grounded intermediate transfer member receives the at least partially recharged layer of liquid toner from the at least partially recharged photo imaging plate and transfers the at least partially recharged layer of liquid toner to a print substrate.

2. The liquid electrophotographic printer of claim 1, wherein a voltage is applied to the second charging element, and wherein the applied voltage is tuned to adjust the recharging of the layer of liquid toner and photo imaging plate.

3. The liquid electrophotographic printer of claim 2, wherein the applied voltage is the same polarity as the charged layer of liquid toner.

4. The liquid electrophotographic printer of claim 2, wherein the applied voltage is tuned to enable substantially all of the at least partially recharged layer of liquid toner to be transferred to an intermediate transfer member.

5. The liquid electrophotographic printer of claim 2, wherein the applied voltage is tuned to enable substantially all of the charge on the at least partially recharged photo imaging plate to be retained on the photo imaging plate.

6. The liquid electrophotographic printer of claim 1, wherein the intermediate transfer member is grounded when the intermediate transfer member receives the at least partially recharged layer of liquid toner from the at least partially recharged photo imaging plate.

7. The liquid electrophotographic printer of claim 1, wherein the intermediate transfer member is grounded when the intermediate transfer member transfers the at least partially recharged layer of liquid toner to the print substrate.

8. The liquid electrophotographic printer of claim 1, wherein the print substrate is conductive.

9. The liquid electrophotographic printer of claim 1, wherein the print substrate is non-conductive.

10. A method of printing an image in a liquid electrophotographic printer, the method comprising:

at least partially discharging a charged photo imaging plate and a charged layer of liquid toner applied on the charged photo imaging plate;

at least partially recharging the layer of liquid toner and the photo imaging plate;

transferring the at least partially recharged layer of liquid toner from the at least partially recharged photo imaging plate to an intermediate transfer member, wherein the intermediate transfer member is grounded; and transferring the at least partially recharged layer of liquid toner from the grounded intermediate transfer member to a print substrate.

11. The method of claim 10 further comprising:

applying a voltage to a charging element and;

tuning the applied voltage to adjust the recharging of the layer of liquid toner and photo imaging plate.

12. The method of claim 11 further comprising:

tuning the applied voltage to enable at least one of:

substantially all of the at least partially recharged layer of liquid toner to be transferred to the grounded intermediate transfer member; and substantially all of the charge on the at least partially recharged photo imaging plate to be retained on the photo imaging plate.

13. The method of claim 10 further comprising:

applying a voltage to a charging element, wherein the voltage is the same polarity as the charged layer of liquid toner.

14. A non-transitory computer readable storage medium comprising a set of computer-readable instructions stored thereon, which, when executed by a processor, cause the processor to, in a liquid electrophotographic printer;

apply a first voltage to a first charging element to charge a photo imaging plate;

control a charge erasing element to at least partially discharge the charged photo imaging plate and to at least partially discharge a charged layer of liquid toner on the charged photo imaging plate;

apply a second voltage to a second charging element to at least partially recharge the layer of liquid toner and the photo imaging plate;

control an intermediate transfer member to receive the at least partially recharged layer of liquid toner from the at least partially recharged photo imaging plate; and control the intermediate transfer member to transfer the at least partially recharged layer of liquid toner to a print substrate;

wherein the processor grounds the intermediate transfer member:

when the intermediate transfer member receives the at least partially recharged layer of liquid toner from the at least partially recharged photo imaging plate; and when the intermediate transfer member transfers the at least partially recharged layer of liquid toner to the print substrate.

* * * * *